US007721795B2

(12) United States Patent
Hendrix et al.

(10) Patent No.: US 7,721,795 B2
(45) Date of Patent: May 25, 2010

(54) HEAT EXCHANGER, ESPECIALLY CHARGE-AIR/COOLANT COOLER

(75) Inventors: Daniel Hendrix, Stuttgart (DE); Florian Moldovan, Stuttgart (DE); Jürgen Wegner, Eislingen/Fils (DE)

(73) Assignee: Behr GmbH & Co. KG, Stuttgart (DE)

( * ) Notice: Subject to any disclaimer, the term of this patent is extended or adjusted under 35 U.S.C. 154(b) by 129 days.

(21) Appl. No.: 10/579,037

(22) PCT Filed: Nov. 10, 2004

(86) PCT No.: PCT/EP2004/012695

§ 371 (c)(1),
(2), (4) Date: May 10, 2006

(87) PCT Pub. No.: WO2005/045343

PCT Pub. Date: May 19, 2005

(65) Prior Publication Data

US 2007/0131402 A1 Jun. 14, 2007

(30) Foreign Application Priority Data

Nov. 10, 2003 (DE) ..... 103 52 880

(51) Int. Cl.
*F28F 3/08* (2006.01)

(52) U.S. Cl. ..... 165/167; 165/170

(58) Field of Classification Search ..... 165/166, 165/167, 170

See application file for complete search history.

(56) References Cited

U.S. PATENT DOCUMENTS 3,862,661 A 1/1975 Kovalenko et al.
4,230,179 A 10/1980 Uehara et al.
4,572,766 A * 2/1986 Dimitriou ..... 165/167
5,174,370 A 12/1992 Hallgren
5,203,406 A * 4/1993 Blomgren et al. ..... 165/167
5,230,966 A * 7/1993 Voss et al. ..... 429/26
5,931,219 A 8/1999 Kull et al.
6,170,568 B1 1/2001 Valenzuela
6,293,337 B1 9/2001 Strähle et al.
6,305,466 B1 10/2001 Andersson et al.

(Continued)

FOREIGN PATENT DOCUMENTS

CH 245491 A 11/1946

(Continued)

OTHER PUBLICATIONS

D. Hendrix, U.S. PTO Notice of Allowance, U.S. Appl. No. 10/579,039, dated Jan. 4, 2010, 6 pages.

(Continued)

*Primary Examiner*—Teresa J Walberg
(74) *Attorney, Agent, or Firm*—Foley & Lardner LLP

(57) ABSTRACT

The invention relates to a heat exchanger, especially a charge-air/coolant cooler (1), consisting of a plurality of disks (2), two adjacent disks (2) defining an intermediate region through which a heat exchanging medium flows. Said heat exchanger also comprises a heat exchanging medium inlet (9) and a heat exchanging medium outlet (11), that are common to the disks (2). At least two heat exchanging medium channels (5, 6) are respectively provided for the heat exchanging medium inlet and the heat exchanging medium outlet (9 and 11).

18 Claims, 2 Drawing Sheets

U.S. PATENT DOCUMENTS

| | | | | |
|---|---|---|---|---|
| 6,389,696 | B1 | 5/2002 | Heil et al. | |
| 6,681,846 | B2 | 1/2004 | Angermann et al. | |
| 6,823,934 | B2 | 11/2004 | Andersson | |
| 2002/0000310 | A1 | 1/2002 | Cheadle | |
| 2003/0047303 | A1* | 3/2003 | Andersson | 165/167 |
| 2003/0098146 | A1 | 5/2003 | Angermann et al. | |
| 2004/0067414 | A1* | 4/2004 | Wei et al. | 429/166 |
| 2004/0206488 | A1* | 10/2004 | Ikuta | 165/167 |
| 2007/0084592 | A1 | 4/2007 | Hendrix et al. | |

FOREIGN PATENT DOCUMENTS

| | | | |
|---|---|---|---|
| CN | 1411547 | A | 4/2003 |
| DE | 195 11 991 | A1 | 10/1996 |
| DE | 198 33 338 | A1 | 1/2000 |
| DE | 199 48 222 | A1 | 4/2001 |
| DE | 691 32 499 | T2 | 4/2001 |
| DE | 699 01 548 | T2 | 12/2002 |
| DE | 203 17 469 | U1 | 4/2004 |
| EP | 0 503 080 | B1 | 9/1992 |
| EP | 1 281 921 | A2 | 2/2003 |
| EP | 1 308 685 | A2 | 5/2003 |
| EP | 1 531 314 | B1 | 5/2005 |
| JP | 56-000993 | A | 1/1981 |
| JP | 61-175763 | U | 11/1986 |
| JP | 64-090971 | A | 4/1989 |
| JP | 01-307595 | A | 12/1989 |
| JP | 4-506996 | A | 12/1992 |
| JP | 2001-133172 | A | 5/2001 |
| WO | WO 97/23759 | A1 | 7/1997 |
| WO | WO 00/46564 | | 8/2000 |
| WO | WO 00/46564 | A1 | 8/2000 |
| WO | WO 01/67021 | A1 | 9/2001 |
| WO | WO 03/010482 | A1 | 2/2003 |
| WO | WO 2005/012819 | A1 | 2/2005 |

OTHER PUBLICATIONS

D. Hendrix, U.S. PTO Office Action, U.S. Appl. No. 10/579,039. dated Jul. 23, 2008, 8 pages.

D. Hendrix, U.S. PTO Office Action, U.S. Appl. No. 10/579,039, dated Jan. 22, 2009, 8 pages.

D. Hendrix, U.S. PTO Office Action, U.S. Appl. No. 10/579,039, dated Jul. 6, 2009, 8 pages.

* cited by examiner

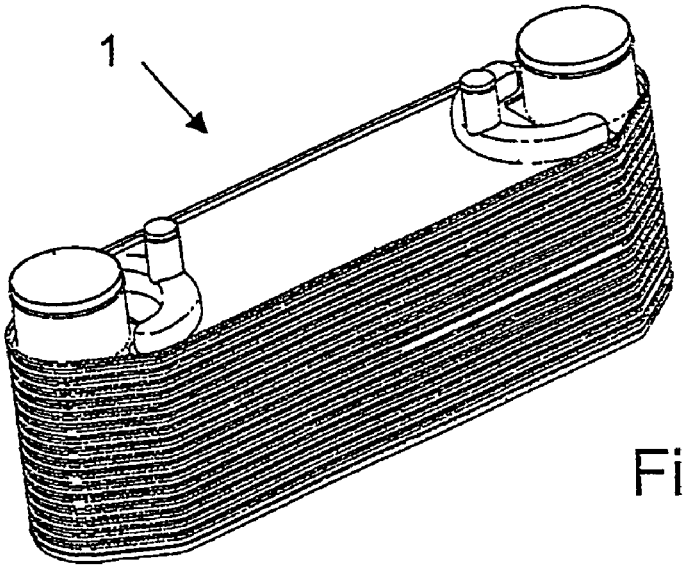
Fig. 2
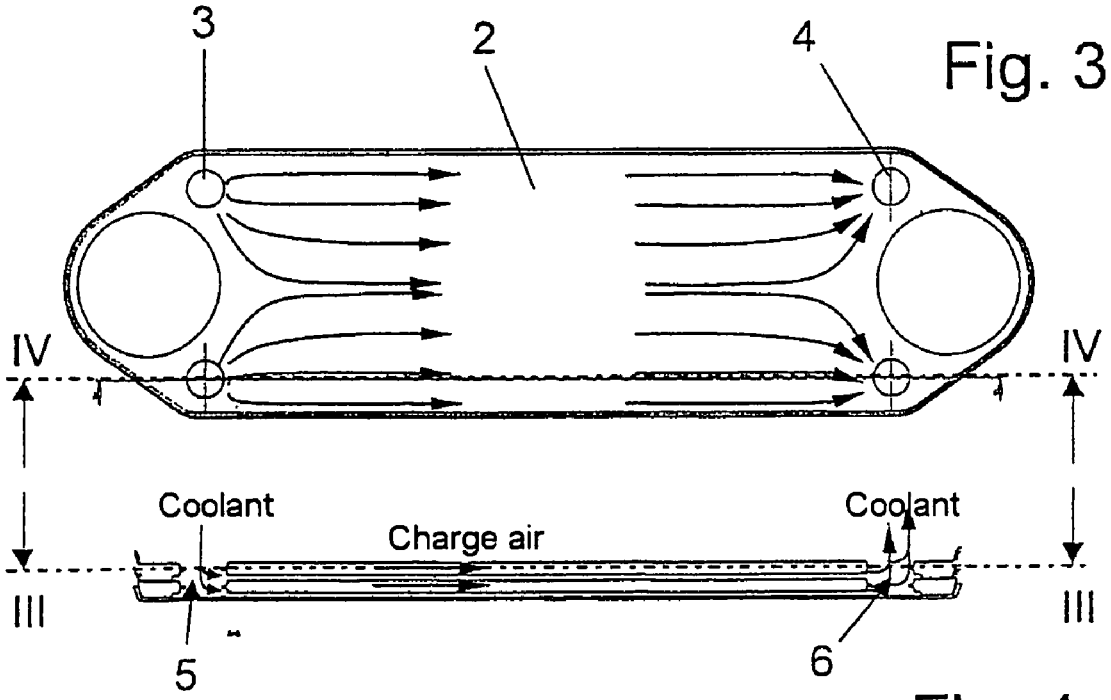
Fig. 3
Fig. 4

HEAT EXCHANGER, ESPECIALLY CHARGE-AIR/COOLANT COOLER

The invention relates to a heat exchanger, in particular a charge-air/coolant radiator, with a disk structure.

In conventional charge-air/coolant radiators with a disk structure, the charge air and the coolant are introduced into the coolant disks via in each case one individual pipe stub. A charge-air/coolant radiator of said type leaves something to be desired, in particular with regard to cooling performance.

It is an object of the invention to provide an improved heat exchanger.

SUMMARY

According to the invention, a heat exchanger, in particular a charge-air/coolant radiator, with a disk structure is provided, having a plurality of disks, two adjacent disks defining an intermediate space through which a heat transfer medium flows, and having in each case one heat transfer medium inlet and heat transfer medium outlet which are common to the disks, at least two heat transfer medium ducts being provided per heat transfer medium inlet and/or outlet. Here, the heat transfer medium ducts are preferably formed by apertures, which are in particular aligned with one another, in the individual disks.

Any other desired correspondingly constructed heat exchanger, for example an oil cooler, can be used instead of a charge-air/coolant radiator. A heat exchanger of said type which is embodied according to the invention permits good distribution of the heat transfer medium over the heat-exchanging faces of the individual disks which form the heat exchanger. The uniform flow distribution reduces the problem of boiling in heat exchangers used in regions which are critical in this regard.

The distribution of the heat transfer medium is assisted by means of an axially symmetrical configuration of the disks, based on their longitudinal axis, with regard to the heat transfer medium ducts. Assembly is simplified if the disks are also designed to be axially symmetrical relative to their transverse axis.

One individual heat transfer medium inlet and/or one individual heat transfer medium outlet which has a branching section and/or converging section is preferably provided. This makes a relatively simple design possible with improved heat transfer on account of the better flow distribution.

The branching section and/or the converging section are preferably designed in the form of an arc of a circle, so that a space-saving construction is possible around the bolts or the like which hold the individual disks together.

A bend of 30° to 90°—as seen in the flow direction—is preferably provided in the region of the branching section and/or converging section, the forked part of the branching section and/or converging section being aligned parallel to the disks.

The heat transfer medium inlet which merges into two heat transfer medium ducts after the branching section preferably runs parallel to the heat transfer medium ducts, while the bipartite part of the branching section is preferably arranged in a plane which is perpendicular to said heat transfer medium ducts. The heat transfer medium outlet which merges from two heat transfer medium ducts into the converging section preferably runs parallel to the heat transfer medium ducts, while the bipartite part of the branching section is preferably arranged in a plane which is perpendicular to said heat transfer medium ducts. This makes a compact and space-saving design of the heat exchanger possible. Alternatively, the supply can also take place by means of two individual, separately embodied tubes which are connected to one another by means of a Y-shaped connecting piece.

A heat exchanger of said type is preferably used as a charge-air/coolant radiator for cooling the charge air. A mixture of water and glycol is preferably used here as the heat transfer medium (coolant).

BRIEF DESCRIPTION OF THE DRAWINGS

The invention is explained in detail in the following on the basis of an exemplary embodiment and with reference to the drawing, in which:

FIG. 2 shows a perspective illustration of the charge-air/coolant radiator of FIG. 1, FIG. 3 shows a section through the charge-air/coolant radiator of FIG. 1 along the line III-III in FIG. 4, and FIG. 4 shows a section through the charge-air/coolant radiator of FIG. 1 along the line IV-IV in FIG. 3.

DETAILED DESCRIPTION

Figure 1:
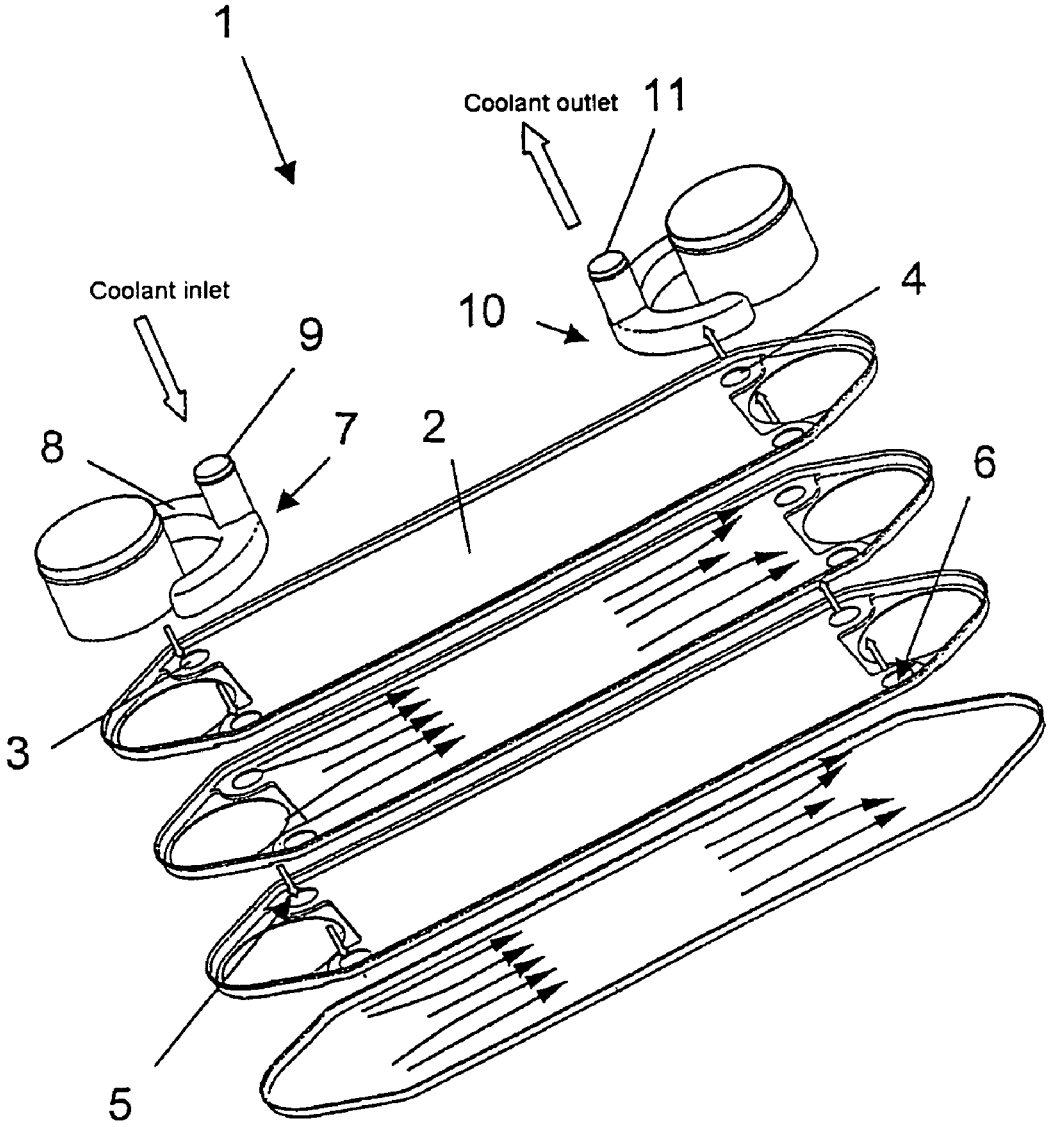
FIG. 1 shows a schematized perspective exploded illustration of a charge-air/coolant radiator with a disk structure according to the exemplary embodiment.

A charge-air/coolant radiator 1 which serves as a heat exchanger between charge air and coolant has a plurality of coolant disks 2 which are stacked on top of one another. Here, two inlet openings 3 and two outlet openings 4, through which coolant as a heat transfer medium is respectively fed into and discharged from the intermediate spaces between the coolant disks 2, are provided in each case in each coolant disk 2. The flow direction is indicated in the figures by arrows. Here, after entering through the inlet openings 3, the coolant is distributed over the entire width of the intermediate spaces between the coolant disks 2 and flows uniformly in the direction of the outlet openings 4 (see FIG. 3), so that flow passes uniformly through the entire length and width of the intermediate spaces between the inlet and outlet openings 3 and 4, and an optimum transfer of heat is possible from the charge air to be cooled which flows through the charge-air/coolant radiator 1 between the individual coolant disks 2.

The openings 3 and 4 of the coolant disks 2 which are stacked on top of one another form coolant ducts 5 and 6. For this purpose, the regions of the openings 3 and 4 are of correspondingly raised design, so that sufficient intermediate space is present such that the charge air can flow through and be cooled between the coolant disks 2.

The two coolant ducts 5 begin—as seen in the flow direction of the coolant—at a branching section 7 which has a bifurcation 8 in the shape of an arc of a circle and a coolant inlet 9 which is arranged centrally in the arc of said bifurcation 8 and is arranged parallel to the coolant ducts 5. The coolant which is fed through the coolant inlet 9 is thus distributed uniformly between the two coolant ducts 5.

The outlet is designed in a corresponding manner to the inlet. The two coolant ducts 6 thus end with a converging section 10 which is designed in a corresponding manner to the branching section 7 and has a coolant outlet 11.

LIST OF REFERENCE DESIGNATIONS

1 Charge-air/coolant radiator
2 Coolant disk
3 Inlet opening
4 Outlet opening
5 Coolant duct

6 Coolant duct
7 Branching section
8 Bifurcation
9 Coolant inlet
10 Converging section
11 Coolant outlet

The invention claimed is:

1. A heat exchanger with a disk structure comprising:

a plurality of disks, wherein each pair of adjacent disks defines an intermediate space through which a heat transfer medium is configured to flow;

a heat transfer medium inlet;

a heat transfer medium outlet; and a first set of at least two heat transfer medium ducts in fluid communication between each intermediate space and one of the heat transfer medium inlet and the heat transfer medium outlet, wherein the at least two heat transfer medium ducts are in fluid communication with the same heat transfer medium inlet so that the at least two heat transfer medium ducts are configured to be supplied with heat transfer medium by the same heat transfer medium inlet;

wherein the first set of at least two heat transfer medium ducts runs perpendicular to the plane of the disks;

wherein the heat transfer medium inlet has a branching section;

wherein the branching section is arranged in a plane which is perpendicular to the at least two heat transfer medium ducts such that the branching section is offset from the plurality of disks and the heat transfer medium inlet is offset from the heat transfer medium ducts such that the heat transfer medium inlet and the heat transfer medium ducts do not share a common axis.

2. The heat exchanger as claimed in claim 1, wherein each intermediate space has a first set of two openings configured to permit flow to enter the intermediate space and a second set of two openings configured to permit flow to exit the intermediate space.

3. The heat exchanger as claimed in claim 2, wherein the first set of at least two heat transfer medium ducts is in fluid communication between the first set of two openings of each intermediate space and the heat transfer medium inlet, and wherein a second set of at least two heat transfer medium ducts is in fluid communication between the second set of two openings and the heat transfer medium outlet.

4. The heat exchanger as claimed in claim 3, wherein each disk in the plurality of disks has an axially symmetrical design, based on its transverse axis, with regard to the first set of at least two heat transfer medium ducts and the second set of at least two heat transfer medium ducts.

5. The heat exchanger as claimed in claim 2, wherein regions of the first and second sets of two openings have a raised design such that charge air can flow through and be cooled between the pairs of adjoining disks.

6. The heat exchanger as claimed in claim 1, wherein each disk in the plurality of disks has an axially symmetrical design, based on its longitudinal axis, with regard to the at least two heat transfer medium ducts.

7. The heat exchanger as claimed in claim 1, wherein the branching section is designed in a form of an arc of a circle.

8. The heat exchanger as claimed in claim 1, wherein a bend of 30° to 90°, as seen in a flow direction, is provided in a region of the branching section.

9. The heat exchanger as claimed in claim 1, wherein a portion of the heat transfer medium inlet that merges into the at least two heat transfer medium ducts after the branching section runs parallel to the at least two heat transfer medium ducts, and wherein a bipartite part of the branching section is arranged in a plane which is perpendicular to the at least two heat transfer medium ducts.

10. The heat exchanger as claimed in claim 1, wherein the heat transfer medium outlet has a converging section.

11. The heat exchanger as claimed in claim 2, wherein the converging section is designed in a form of an arc of a circle.

12. The heat exchanger as claimed in claim 2, wherein a bend of 30° to 90°, as seen in a flow direction, is provided in a region of the converging section.

13. The heat exchanger as claimed in claim 2, wherein a portion the heat transfer medium outlet that merges from the at least two heat transfer medium ducts into the converging section runs parallel to the at least two heat transfer medium ducts, and wherein a bipartite part of the converging section is arranged in a plane which is perpendicular to the at least two heat transfer medium ducts.

14. The heat exchanger as claimed in claim 1, wherein the heat exchanger is a charge-air/coolant radiator or oil cooler.

15. The heat exchanger as claimed in claim 1, wherein each intermediate space is configured such that the heat transfer medium is distributed over an entire width of the intermediate space.

16. The heat exchanger as claimed in claim 1, wherein heat exchanger forms the heat transfer medium outlet as part of the heat exchanger.

17. The heat exchanger as claimed in claim 1, wherein the branch section is offset from the plurality of disks such that the branch section is formed separately from the plurality of disks.

18. The heat exchanger as claimed in claim 1, further comprising an opening for a second medium, wherein the branching section comprises a concave section, wherein the opening for the second medium is located within the concave section such that the branching section extends around at least a portion of the opening for the second medium.

* * * * *